US007271542B2

(12) United States Patent
Ito et al.

(10) Patent No.: US 7,271,542 B2
(45) Date of Patent: Sep. 18, 2007

(54) GAS DISCHARGE TUBE

(75) Inventors: Yoshinobu Ito, Hamamatsu (JP); Masaki Ito, Hamamatsu (JP); Koji Matsushita, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 218 days.

(21) Appl. No.: 10/544,616

(22) PCT Filed: Feb. 19, 2004

(86) PCT No.: PCT/JP2004/001927

§ 371 (c)(1),
(2), (4) Date: Aug. 5, 2005

(87) PCT Pub. No.: WO2004/075243

PCT Pub. Date: Sep. 2, 2004

(65) Prior Publication Data

US 2006/0145617 A1 Jul. 6, 2006

(30) Foreign Application Priority Data

Feb. 20, 2003 (JP) ..... 2003-042953

(51) Int. Cl.
*H01J 17/02* (2006.01)

(52) U.S. Cl. ..... 313/612; 313/611

(58) Field of Classification Search ..... 313/492, 313/609, 611, 612, 613, 626
See application file for complete search history.

(56) References Cited

U.S. PATENT DOCUMENTS 5,191,260 A 3/1993 Kawai et al.
5,552,669 A 9/1996 Ikedo et al.
5,587,625 A 12/1996 Ikedo et al.
5,619,101 A 4/1997 Ikedo et al.
5,633,563 A 5/1997 Ikedo et al.
5,646,487 A 7/1997 Ikedo et al.
5,684,363 A 11/1997 Ikedo et al.

(Continued)

FOREIGN PATENT DOCUMENTS

EP 0 473 378 A2 3/1992

(Continued)

*Primary Examiner*—Vip Patel
(74) *Attorney, Agent, or Firm*—Drinker Biddle & Reath LLP

(57) ABSTRACT

A gas discharge tube 10 of the present invention generates an electric discharge between an anode part 24 and a cathode part 56 disposed inside a sealed container 12 in which gas has been contained. The gas discharge tube 10 comprises an electric discharge path restricting part 28 which is cylindrical and disposed between the anode part and the cathode part, and which has a throughhole 42 for narrowing an electric discharge path between the anode part and the cathode part; and an electric discharge shielding part 50 which is disposed to surround the electric discharge path restricting part so as to restrict an electric discharge from the outer peripheral surface of the electric discharge path restricting part to the cathode part, and which is electrically isolated from the electric discharge path restricting part. The end part of the electric discharge path restricting part on the cathode part side projects beyond a surface of the electric discharge shielding part on the cathode side by a predetermined amount "P" of projection. With this structure, a high density electron region is formed exclusively in a part of the throughhole of the electric discharge path restricting part on the cathode side, thereby ensuring the generation of a startup discharge.

7 Claims, 6 Drawing Sheets

U.S. PATENT DOCUMENTS

| | | | |
|---|---|---|---|
| 5,698,945 | A | 12/1997 | Ikedo et al. |
| 5,886,470 | A | 3/1999 | Smolka |
| 6,380,663 | B1 | 4/2002 | Ikedo et al. |
| 6,531,821 | B1 | 3/2003 | Ikedo et al. |
| 6,559,576 | B1 | 5/2003 | Ikedo et al. |
| 6,573,655 | B1 | 6/2003 | Ikedo et al. |
| 6,586,866 | B1 | 7/2003 | Ikedo et al. |
| 6,741,036 | B1 | 5/2004 | Ikedo et al. |
| 2004/0021419 | A1 | 2/2004 | Ito et al. |
| 2004/0041523 | A1 | 3/2004 | Kawai et al. |
| 2004/0046506 | A1 | 3/2004 | Kawai et al. |

FOREIGN PATENT DOCUMENTS

| | | | |
|---|---|---|---|
| EP | 0 685 874 | A1 | 12/1995 |
| EP | 0 700 071 | A2 | 3/1996 |
| EP | 1 143 486 | A1 | 10/2001 |
| EP | 1 154 462 | A1 | 11/2001 |
| JP | 05-159749 | A | 6/1993 |
| JP | 06-215734 | A | 8/1994 |
| JP | 07-288106 | A | 10/1995 |
| JP | 10-064479 | | 3/1998 |
| JP | 2000-173547 | | 6/2000 |
| JP | 2001-256924 | | 9/2001 |
| JP | 2002-151008 | | 5/2002 |
| JP | 2002-151009 | | 5/2002 |
| JP | 2002-151010 | | 5/2002 |
| WO | WO 02/41359 | | 5/2002 |
| WO | 03/030208 | A1 | 4/2003 |
| WO | 03/094199 | A1 | 11/2003 |

GAS DISCHARGE TUBE

TECHNICAL FIELD

The present invention relates to a gas discharge tube such as a heavy hydrogen lamp to be used particularly as a light source for spectroscopy, chromatography, etc.

BACKGROUND ART

As conventional techniques in the above-described field, those disclosed in Japanese Unexamined Patent Publication No. H7-288106 and Japanese Unexamined Patent Publication No. H10-64479 are known. In either gas discharge tube, a barrier wall made of metal is disposed on an electric discharge path between an anode part and a cathode part, and a small hole is formed on the barrier wall so as to narrow the electric discharge path. In such a structure, light with high brightness can be obtained by the small hole on the electric discharge path. In particular, in the gas discharge tube of Japanese Unexamined Patent Publication No. H7-288106, brightness is further increased by extending the length of the small hole, that is, a portion of the electric discharge path that is narrowed. On the other hand, in the gas discharge tube of Japanese Unexamined Patent Publication No. H10-64479, higher brightness is achieved by disposing a plurality of barrier walls in addition to extending the length of the small hole.

The demand for higher brightness in the technical field of gas discharge tubes has been comparatively satisfied by the techniques disclosed in the above-described patent publications.

However, when the narrowed portion of the electric discharge path is extended in length, an electric discharge is less liable to occur. To avoid this problem, in the gas discharge tube disclosed in the above second patent publication, a plurality of metal barrier walls are disposed to generate an electric discharge step by step; however, there is a problem in that this complicates a power supply circuit.

Therefore, an object of the present invention is to provide a gas discharge tube which can securely generate an electric discharge, regardless of the length of a portion of the electric discharge path that is narrowed.

DISCLOSURE OF THE INVENTION

In order to achieve the above-mentioned object, the present invention provides a gas discharge tube comprising: a sealed container in which gas is contained; an anode part disposed in the sealed container; a cathode part defining an electric discharge part for generating an electric discharge with the anode part, the cathode part being disposed inside the sealed container in such a manner as to be distanced from the anode part; an electric discharge path restricting part being cylindrical and conductive, and having a throughhole for narrowing the electric discharge path, the electric discharge path restricting part being disposed between the anode part and the cathode part, and being adapted to be electrically connected with an external power source; and an electric discharge shielding part disposed to enclose the electric discharge path restricting part and electrically isolated from the electric discharge path restricting part, wherein the electric discharge path restricting part and the electric discharge shielding part are positioned in such a manner that an end part of the electric discharge path restricting part on the cathode part side projects beyond a surface of the electric discharge shielding part on the cathode part side by a predetermined amount. It is preferable that the amount of projection be approximately 0.5 mm at maximum.

With this arrangement, most of the electric discharge path extending from the outer peripheral surface of the electric discharge path restricting part to the cathode part is shielded by the electric discharge shielding part. Furthermore, only a portion of the end part of the electric discharge path controlling part that is on the cathode part side, or a portion with a maximum of approximately 0.5 mm as an amount of projection forms an electric discharge path for a startup discharge with the cathode part. Consequently, when electric power for startup is turned on, a high density electron region is formed exclusively in the vicinity of a projecting tip portion of the electric discharge path restricting part and a portion of the throughhole that is on the cathode part side. This ensures the generation of a startup discharge.

Preferably, the throughhole in the electric discharge path restricting part comprises a small hole part which is provided on the anode part side and which has a constant inner diameter, and an increased diameter hole part which is linked with the small hole part and extends toward the cathode part side while increasing in diameter toward the cathode part side in a funnel shape. The small hole part functions as a portion for narrowing the electric discharge path, and the increased diameter hole part forms an excellent arc ball inside, thereby contributing to higher brightness.

By making the increased diameter hole part in the electric discharge path restricting part have an inner peripheral surface which extends beyond a surface of the electric discharge shielding part that is on the cathode part side toward a surface of the electric discharge shielding part that is on the anode part side, the formation of the high density electron region is concentrated particularly inside the increased diameter hole part. Therefore, further ensuring the generation of the startup discharge. When the inner diameter of the small hole part in the electric discharge path restricting part is made D1 and the maximum inner diameter of the increased diameter hole part is made D2, it is effective to set D2 in the range of 1 mm to 3 mm, and to set the ratio D2/D1 in the range of 4 to 10 so as to achieve a higher density electron region and an excellent arc ball formation.

It is also preferable that the electric discharge shielding part be made of electrically insulating material in order to easily provide electric isolation with the electric discharge path restricting part.

The above-mentioned object, other features and advantages of the present invention will be made clear to those skilled in the art through a following detailed description with reference to accompanying drawings.

BEST MODES FOR CARRYING OUT THE INVENTION

Now, preferable embodiments of the gas discharge tube of the present invention will be described in detail with reference to accompanying drawings. In the following description, it is to be understood that various terms indicating directions such as "upeardly", "dowinwardly" and the like are referred to based on the conditions of corresponding drawings for the sake of convenience, and should not be construed as limiting terms.

FIRST EMBODIMENT

Figure 1:
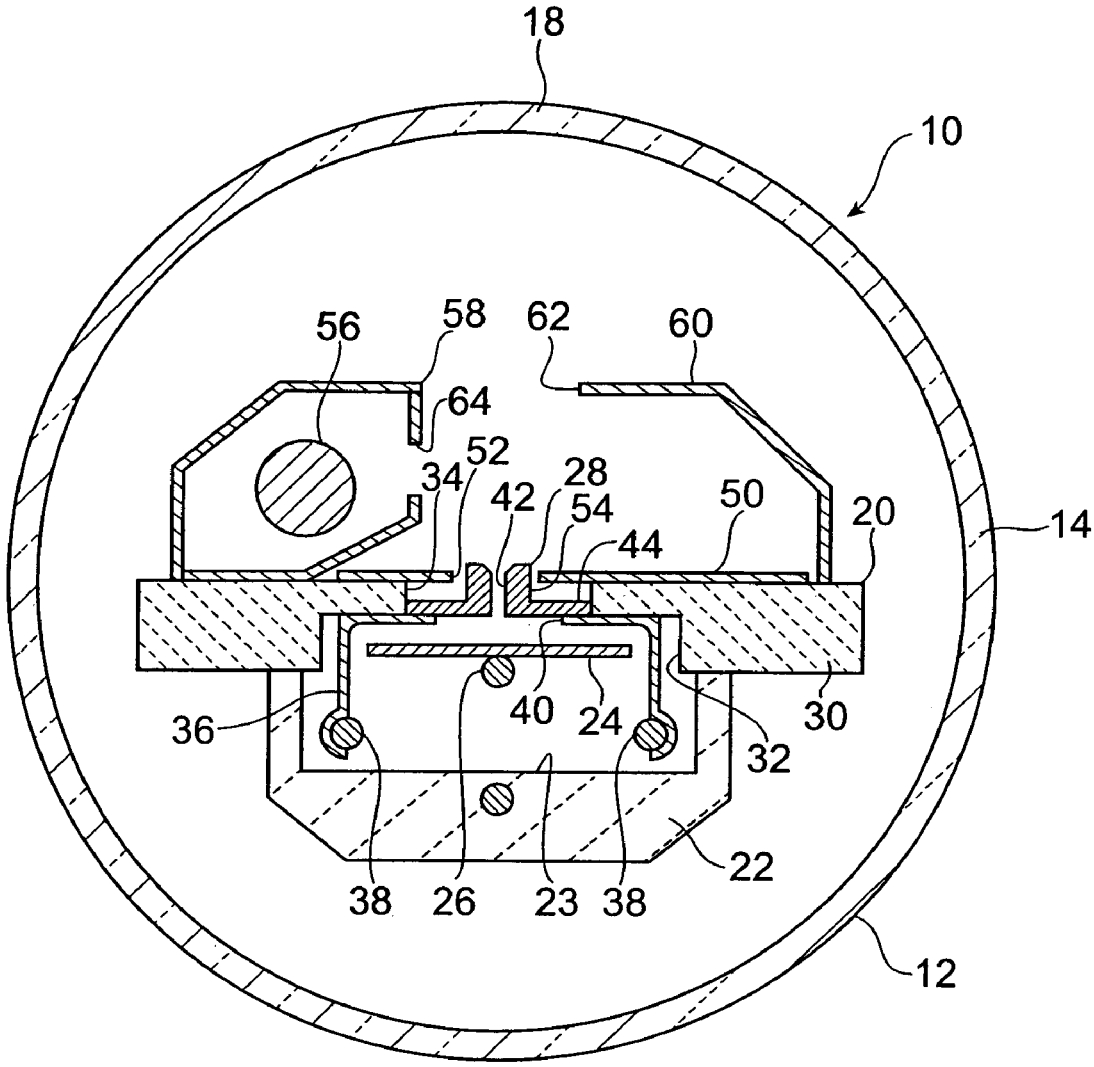
FIG. 1 is an end view showing a first embodiment of a gas discharge tube of the present invention.

FIG. 1 shows an end view in a condition where a first embodiment of the gas discharge tube of the present invention is cut in the direction orthogonal to the axis (tube axis). A gas discharge tube 10 shown in FIG. 1 is a side-on type heavy hydrogen lamp, and has a sealed container 12 made of glass in which several hundreds of Pa of heavy hydrogen gas has been sealed. The sealed container 12 comprises a side tube part 14 which is cylindrical and sealed at one end thereof, and a stem part (not shown) for sealing the other end of the side tube part 14. A portion of the side tube part 14 is used as a light emitting window 18. The sealed container 12 accommodates a light emission part assembly 20 therein.

The light emission part assembly 20 includes a base part 22 which is electrically insulating made of ceramics or the like. The base part 22 is disposed opposite the light emitting window 18, and has a concave part 23 on its upper surface. Over the base part 22 is formed a plate-shaped anode part 24. Onto the rear side of the anode part 24, a tip portion of a stem pin 26 is fixedly connected electrically. The tip portion extends in the direction of the tube axis (the center axis of the side tube part 14), and stands on the stem part.

The light emission part assembly 20 also has an electric-discharge-path-restricting-part supporting part (hereinafter referred to as supporting part) 30 for supporting an electric discharge path restricting part 28 that will be described later. The supporting part 30 is tabular and made of ceramics or the like so as to be electrically insulating, and is fixed on the top end surface of the outer peripheral part of the base part 22. The supporting part 30 has a concave part 32 on a bottom surface center thereof. The bottom surface (downward surface) and side surfaces of the concave part 32 are distanced from the anode part 24 by a predetermined spacing. The supporting part 30 has an opening 34 in its center.

Furthermore, a conductive plate 36 is provided along the bottom and side surfaces of the concave part 32 of the supporting part 30 in such a manner as to be in contact with these surfaces. The conductive plate 36 is electrically connected with the tip portion of a stem pin 38 standing on the stem part. The conductive plate 36 has an opening 40 in its center, which is disposed coaxially with the opening 34 of the supporting part 30 when the conductive plate 36 is applied to the supporting part 30. The inner diameter of the opening 40 is designed to be smaller than the inner diameter of the opening 34.

In the center of the upper surface of the conductive plate 36, an electric discharge path restricting part 28 made of conductive material such as metal (e.g., molybdenum, tungsten, or an alloy of these) is fixedly welded in such a manner as to be coaxial with the openings 34 and 40. This makes it possible to feed electric power from outside to the electric discharge path restricting part 28 via the conductive plate 36 and the stem pin 38.

Figure 2:
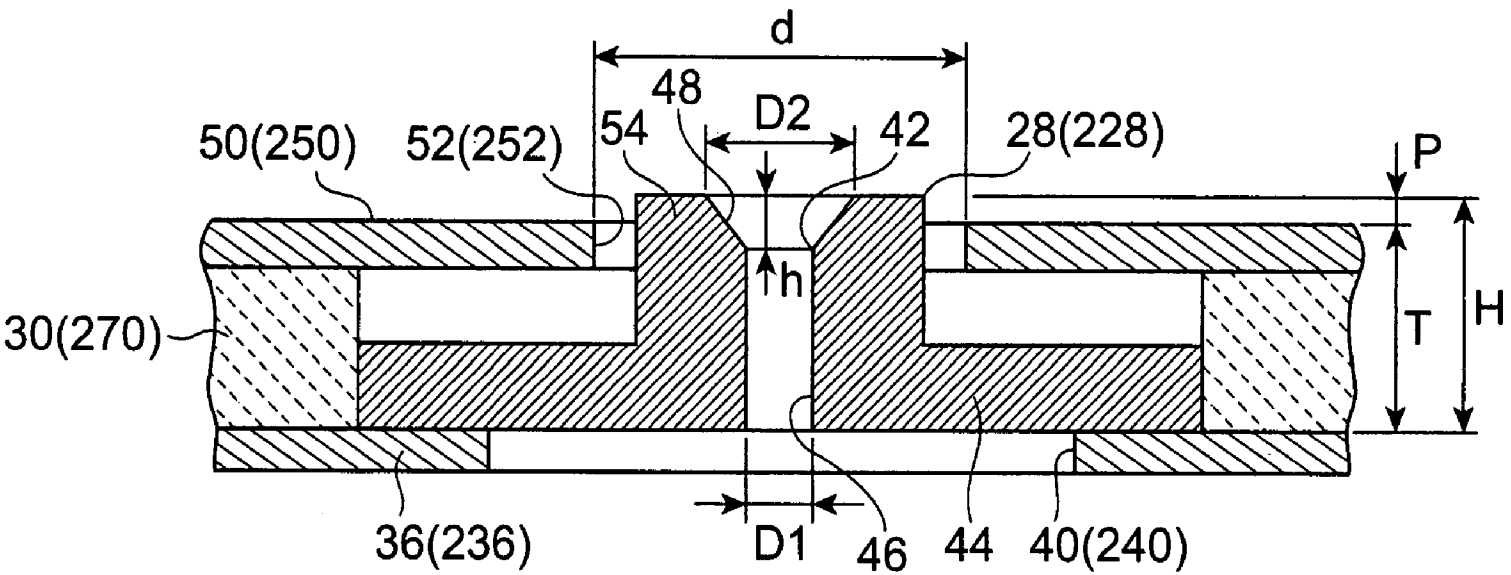
FIG. 2 is an enlarged cross sectional view of a vicinity of an electric discharge path restricting part in the gas-discharge tube shown in FIG. 1.

As shown in FIG. 2, the electric discharge path restricting part 28 is shaped like a cylinder having a throughhole 42 inside for narrowing the electric discharge path, and is provided with a flange part 44 for fixing at the end part on the anode part 24 side. The outer diameter of the flange part 44 is substantially equal to the inner diameter of the opening 34 of the supporting part. 30. Therefore, after the flange part 44 is inserted into the opening 34 and the bottom surface of the flange part 44 is brought into contact with the upper surface of the conductive plate 36, the flange part 44 is fixed to the conductive plate 36 by welding or the like, thereby making the supporting part 30 support the electric discharge path restricting part 28. Since the electric discharge path restricting part 28 has a convex-shaped side surface with the flange part 44, the top end portion projecting toward the cathode side can be reduced, thereby contributing to ensuring a startup discharge which will be described later.

The throughhole 42 of the electric discharge path restricting part 28 is formed of a small hole part 46 which is provided on the anode part 24 side in such a manner as to have a constant inner diameter, and of an increased diameter hole part 48 which is linked with the small hole part 46 and extends upward while increasing in diameter in a funnel shape. The small hole part 46 is mainly for narrowing the electric discharge path, and the increased diameter hole part 48 is mainly for forming an arc ball, and in the present embodiment, has a cone-shaped inner peripheral surface. In order to narrow the electric discharge path, it is preferable that the small hole part 46 has an inner diameter D1 of 0.5 mm or so. In addition, it is preferable that a maximum inner diameter D2 of the increased diameter hole part 48, that is, the inner diameter D2 of the throughhole 42 on the end surface on the cathode side be in the range of 1 mm to 3 mm, and it is further preferable that D2/D1 or the ratio of the inner diameter D2 to the diameter D1 of the small hole part 46 is in the range of 4 to 10.

An electric discharge shielding part 50 with a tabular shape is disposed on the upper surface (the surface on the cathode side) of the supporting part 30 in such a manner as to be in contact with these surfaces. In this first embodiment, the electric discharge shielding part 50 is made of conductive material such as metal. The electric discharge shielding part 50 has an opening 52, and the electric discharge shielding part 50 is positioned with respect to the supporting part 30 in such a manner that the opening 52 is coaxial with the opening 34 of the supporting part 30. As shown in FIG. 2, the opening 52 of the electric discharge shielding part 50 has an inner diameter "d" which is slightly larger than an outer diameter D3 of the cylindrical part (the portion upper than the flange part 44) 54 of the electric discharge path restricting part 28. In an assembled condition, the cylindrical part 54 of the electric discharge path restricting part 28 is inserted in the opening 52 of the electric discharge shielding part 50 such that the electric discharge shielding part 50 surrounds the cylindrical part 54. A clearance, which is formed between the inner peripheral surface of the opening 52 of the electric discharge shielding part 50 and the outer peripheral surface of the cylindrical part 54 of the electric discharge path restricting part 28, is made small so as to cause slight or substantially no leakage of an electric discharge passing through the clearance. The presence of the clearance provides electric isolation between the electric discharge shielding part 50 attached to the supporting part 30 that is electrically insulating and the electric discharge path restricting part 28, and also puts the electric discharge shielding part 50 out of contact with other parts to be applied with a potential and hence in a potentially floating state.

The whole length (height) "H" of the electric discharge path restricting part 28 is slightly larger than a sum "T" of the thicknesses of the supporting part 30 and the electric discharge shielding part 50, so that the top end of the electric discharge path restricting part 28 projects upward beyond the upper surface of the electric discharge shielding part 50. The amount of projection "P" is approximately 0.5 mm at maximum, and preferably 0.3 mm. A length "h" of the increased-diameter hole part 48, which is a cathode-side portion of the throughhole 42 in the electric discharge path restricting part 28, is larger than the amount of projection "P." In other words, the bottom end of the increased diameter hole part 48 (the border between the increased diameter hole part 48 and the small hole part 46) is closer to the anode part 24 than the upper surface of the electric discharge shielding part 50.

The light emission part assembly 20 also includes a cathode part 56 which is disposed outside the light path on the light emission window 18 side. The cathode part 56 is provided for generating thermal electrons, and more specifically, is formed by coating electron emitting material onto a coil which is extended in the tube axial direction and is made of tungsten. The cathode part 56 is electrically connected with the tip portion of an unillustrated stem pin standing on the stem part via a connection pin so as to allow feeding of electric power from outside.

The light emission part assembly 20 also includes an electric discharge distributor 58 made of metal and a front surface cover 60 in order to prevent materials spattered or evaporated from the cathode part 56 from adhering to the light emission window 18. The electric discharge distributor 58 is disposed to surround the cathode part 56 and is fixed on the upper surface of the supporting part 30. The front surface cover 60 is opposite the electric discharge distributor 58 and is fixed on the upper surface of the supporting part 30. Between the electric discharge distributor 58 and the front surface cover 60, a light passage opening 62 for letting discharge light pass through is formed. The electric discharge distributor 58 has an opening 64 formed in a portion that faces the front surface cover 60, and thermal electrons generated in the cathode part 56 pass through the opening 64.

Now, operations of the above-mentioned gas discharge tube 10 will be described.

First, before an electric discharge, for 20 seconds or so, electric power of approximately 10 W is supplied to the cathode part 56 from a cathode external power source (not shown) via a stem pin (not shown) so as to preheat a coil composing the cathode part 56. Next, a voltage of approximately 160V is applied between the cathode part 56 and the anode part 24 from a main discharge external power source (not shown) via the stem pin 26, thereby preparing an arc discharge.

Later, a predetermined voltage, e.g. approximately 350V is applied between the electric discharge path restricting part 28 and the anode part 24 via the stem pins 38 and 26 from a trigger external power source (not shown). As a result, a startup discharge occurs between the cathode part 56 and a projecting portion of the electric discharge path restricting part 28 that is closer to the cathode part 56 than the upper surface of the electric discharge shielding part 50.

Here, in this embodiment, most of the electric discharge path from the outer surface of the electric discharge path restricting part 28 to the cathode part 56 is shielded by the electric discharge shielding part 50, and an electric discharge path for a startup discharge is formed with the cathode part 56 only in the projecting portion on the top end of the cylindrical part 54 of the electric discharge path controlling part 28, that is, the portion corresponding to the amount of projection "P" of 0.5 mm at maximum, and preferably 0.3 mm. Consequently, a high density electron region is formed exclusively in and around the increased diameter hole part 48 of the electric discharge path restricting part 28. Furthermore, since the cone-shaped inner peripheral surface of the increased diameter hole part 48 is extended further downward than the upper surface of the electric discharge shielding part 50, the high density electron region is formed particularly inside the increased diameter hole part 48. This ensures the generation of a startup discharge.

The occurrence of a startup discharge between the top end part of the electric discharge path restricting part 28 and the cathode part 56 is followed by the occurrence of a startup discharge between the cathode part 56 and the anode part 24, and later, a main discharge (arc discharge) is generated due to a main discharge external electrode. Such a gradual generation of an electric discharge ensures the generation of a main discharge even when the whole length "H" of the electric discharge path restricting part 28 is made large enough for narrowing the electric discharge path (e.g. 2 mm or larger).

After generation of a main discharge, the electric power from the cathode external power source is adjusted to optimize the temperature of the cathode part 56. This maintains the main discharge between the cathode part 56 and the anode part 24, and forms an arc ball inside the increased diameter hole part 48 of the electric discharge path restricting part 28. Since the electric discharge path is narrowed with a sufficient length in the electric discharge path restricting part 28 and the arc ball is formed, ultraviolet rays to be generated are released outside, as light with extremely high brightness, after passing through the light emission window 18 of the sealed container 12 from the light passage opening 62 between the electric discharge distributor 58 and the front surface cover 60. The inner peripheral surface of the increased diameter hole part 48 is cone-shaped; the inner diameter D2 of the increased diameter hole part 48 at maximum is in the range of 1 mm to 3 mm and the relationship D2/D1 with the inner diameter D1 of the small hole part 46 is made in the range of 4 to 10, so that the arc ball is formed in a stable and excellent shape. Consequently, the brightness and amount of light to be emitted becomes stable. Making D1 and D2 the above-mentioned size can further stimulate an increase in density of the electron region in the increased diameter hole part 48.

Figure 3:
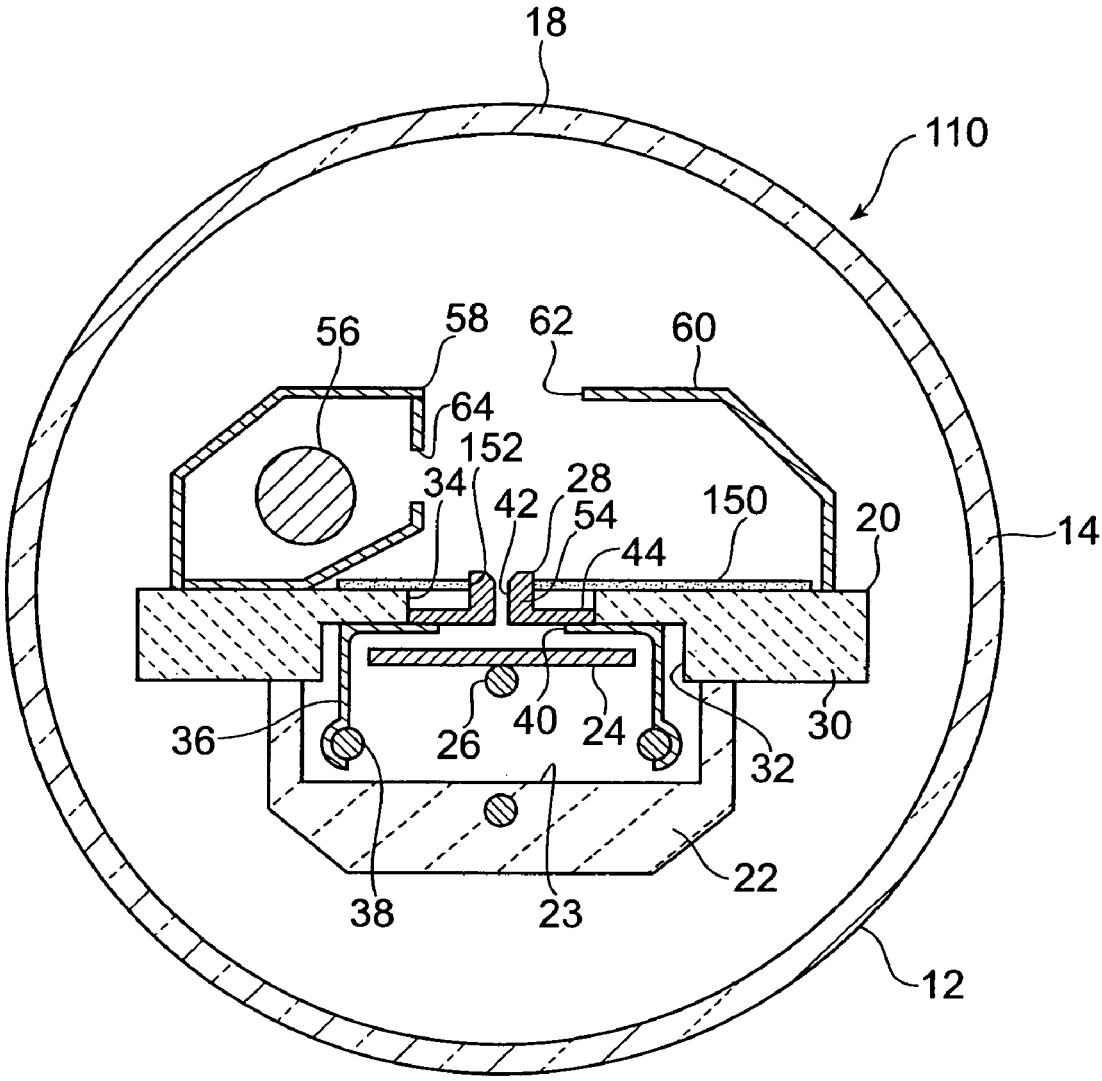
FIG. 3 is an end view showing a modified example of the gas discharge tube of the first embodiment.

FIG. 3 shows a modification of the gas discharge tube 10 shown in FIG. 1 and FIG. 2. The gas discharge tube 110 shown in FIG. 3 differs from the gas discharge tube 10 shown in FIG. 1 and FIG. 2 in that an electric discharge shielding part 150 is made of electrically insulating material such as ceramics. The gas discharge tube 110 is substantially the same as the gas discharge tube 10 in other aspects, so that components the same as or equivalent to those in FIG. 1 and FIG. 2 are referred to with the same reference numbers and overlapping description is omitted.

In the gas discharge tube 110 shown in FIG. 3, as described above, the electric discharge shielding part 150 is made of electrically insulating material such as ceramics, so that even when it is in contact with the electric discharge path restricting part 28, an electric discharge can be shielded. This makes it easy to provide electrical isolation of the electric discharge shielding part 150 from the electric discharge path restricting part 28 even when the positional precision between the electric discharge path restricting part 28 and the electric discharge shielding part 150 is low, thereby facilitating the manufacture. Furthermore, in this modification, as clearly shown in FIG. 4, the inner diameter of the opening 152 of the electric discharge shielding part 150 is nearly equal to the outer diameter of the cylindrical part 54 of the electric discharge path restricting part 28, thereby causing no clearance between the electric discharge shielding part 150 and the electric discharge path restricting part 28. Consequently, the electric discharge path between the outer peripheral surface of the electric discharge path restricting part 28 below the electric discharge shielding part 150 and the cathode part 56, has a high shielding effect, and electrons have a higher density inside the increased diameter hole part 48 of the electric discharge path restricting part 28, thereby securing the generation of a main discharge from a startup discharge.

Figure 5:
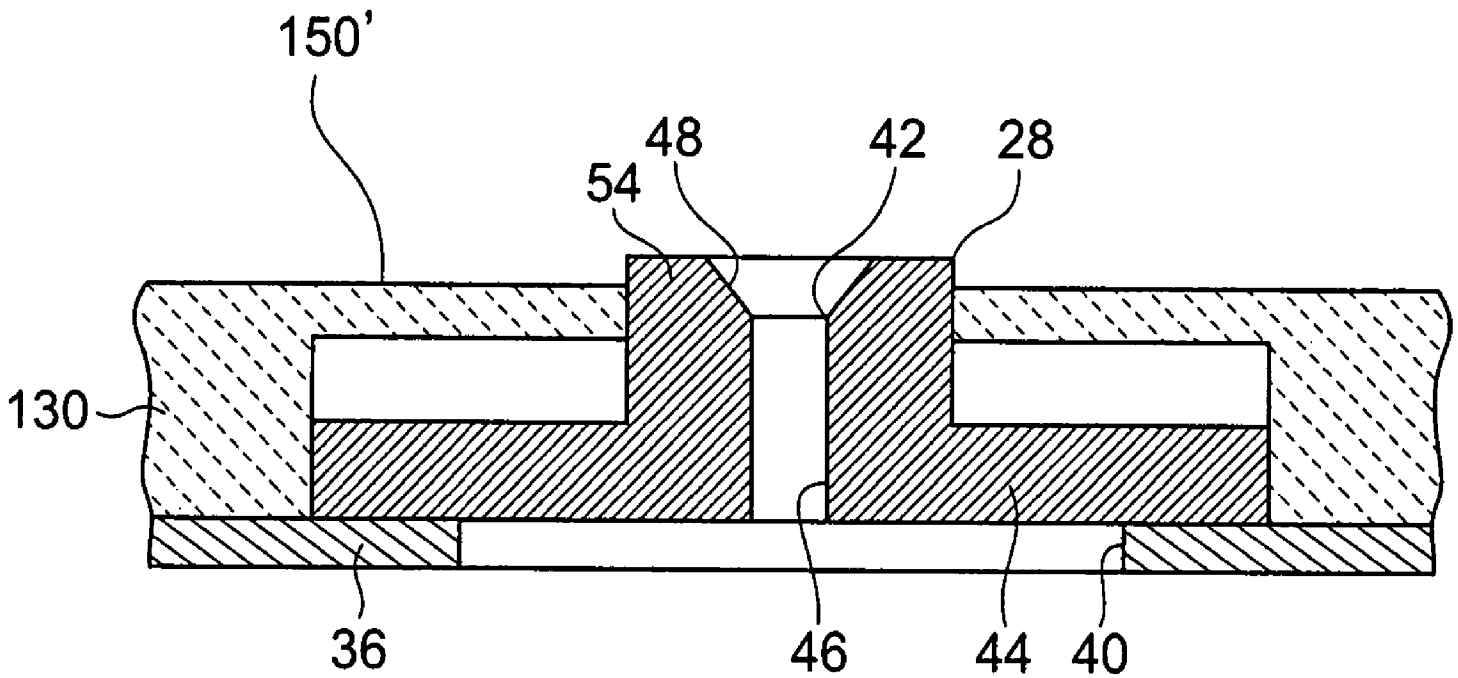
FIG. 5 is a cross sectional view showing another modified example of the vicinity of the electric discharge path restricting part.

As shown in FIG. 5, the electric discharge shielding part 150' can be formed integral with the supporting part 130. This is because both of them are made of electrically insulating material such as ceramics. Such an integral formation can reduce the number of components and facilitate the manufacture.

SECOND EMBODIMENT

Figure 6:
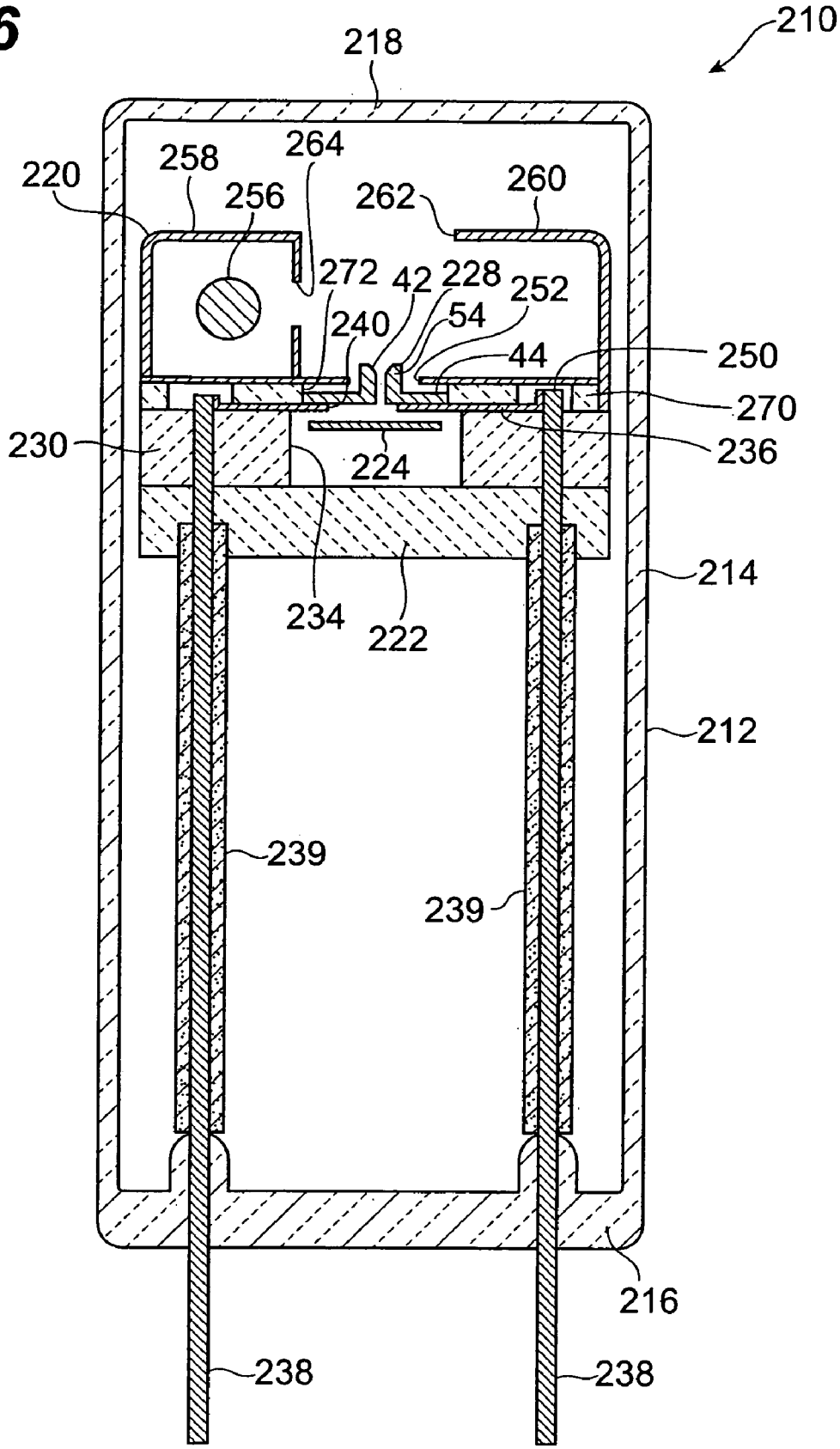
FIG. 6 is an end view showing a second embodiment of the gas discharge tube of the present invention.

FIG. 6 is an end view showing a second embodiment of the gas discharge tube of the present invention cut along the axial direction. A gas discharge tube 210 is a head-on type heavy hydrogen lamp, and has a sealed container 212 made of glass in which several hundreds of Pa of heavy hydrogen gas has been sealed. The sealed container 212 comprises a side tube part 214 which is cylindrical, a stem part 216 for sealing the bottom end side of the side tube part 214, and a light emission window 218 for sealing the top end side of the side tube part 214. The sealed container 212 accommodates a light emission part assembly 220.

The light emission part assembly 220 includes a base part 222 which is tabular and made of ceramics or the like to be electrically insulating. The base part 222 is disposed opposite the light emitting window 218. Over the base part 212 is formed an anode part 224. With the anode part 224, a tip portion of a stem pin (not shown) extending in the direction of the tube axis (the center axis of the side tube) standing on the stem part 216 is connected electrically.

The light emission part assembly 220 also has an electric-discharge-path-restricting-part supporting part (supporting part) 230, which is made of ceramics or the like to be electrically insulating. The supporting part 230 is disposed and fixed onto the upper surface of the base part 222. In the center of the supporting part 230, a circular opening 234 is formed, into which the main portion (the portion shown in FIG. 6) of the anode part 224 is accommodated. In a condition where the main portion of the anode part 224 is disposed in the opening 234 and the supporting part 230 is laid and fixed onto the base part 222, an unillustrated end part of the anode part 224 is sandwiched between the supporting part 230 and the-base part 222.

In addition, on the upper surface of the supporting part 230 is disposed a conductive plate 236 in such a manner as to be in contact with these surfaces. The conductive plate 236 is electrically connected with the tip portion of the stem pin 238 standing on the stem part 216. The stem pin 238, and the above-mentioned stem pin connected with the anode part 224 are wrapped with an electrically insulating tube 239 made of ceramics or the like so as not to be exposed between the stem part 216 and the base part 222.

The conductive plate 236 has a circular opening 240 provided therein. The opening 240 has an inner diameter smaller than the inner diameter of the opening 234 of the supporting part 230. The opening 240 is disposed to be coaxial with the opening 234 of the supporting part 230 in a condition where the conductive plate 236 is fixed to the supporting part 230.

In the center of the upper surface of the conductive plate 236, an electric discharge path restricting part 228 made of metal for narrowing or restricting the electric discharge path from the anode part 224 is fixedly welded in such a manner as to be coaxial with the openings 234 and 240. This enables electric power to be fed to the electric discharge path restricting part 228 from outside via the conductive plate 236 and the stem pin 238.

The electric discharge path restricting part 228 is substantially equivalent to the electric discharge path restricting part 28 of the first embodiment, that is, the one shown in FIG. 2. Therefore, when it is briefly described with the same reference numbers and with reference to FIG. 2, the electric discharge path restricting part 228 is formed of the cylindrical part 54 and the flange part 44, and has inside the throughhole 42 formed of the small hole part 46 and the increased diameter hole part 48.

The light emission part assembly 220 is further provided with a disc-shaped supporting part 270 for supporting an electric discharge shielding part 250 which will be described later. The supporting part 270 is made of electrically insulating material such as ceramics, and is disposed on the upper surface of the supporting part 230 in such a manner as to be in contact with these surfaces. The supporting part 270 has an opening 272 in its center for receiving the electric discharge path restricting part 228 therethrough.

The electric discharge shielding part 250 is a conductive disc made of metal or the like and is disposed on the upper surface of the supporting part 270 in such a manner as to be in contact with these surfaces. The electric discharge shielding part 250 has an opening 252 in its center, which is made coaxial with the opening 272 of the supporting part 270 when in an assembled condition. The whole length "H" of the electric discharge path controlling part 228 is slightly larger than a sum "T" of the thicknesses of the supporting part 270 and the electric discharge shielding part 250, so that in an assembled condition, the top end of the electric discharge path restricting part 228 projects upward beyond the upper surface of the electric discharge shielding part 250 by an amount of projection "P" of approximately 0.5 mm at maximum, and preferably approximately 0.3 mm, while passing through the opening 252 of the electric discharge shielding part 250. The amount of projection "P" is smaller than the length "h" of the increased diameter hole part 48 of the electric discharge path restricting part 228, and the bottom end of the increased diameter hole part 48 is located lower than the upper surface of the electric discharge shielding part 250. Furthermore, the inner diameter of the opening 252 is slightly larger than the outer diameter of the cylindrical part 54 of the electric discharge path restricting part 228, thereby forming a small clearance between them. The clearance lets the electric discharge shielding part be isolated from the electric discharge path restricting part 228 and other parts to be applied with a potential. This clearance enables substantial discharge shielding.

The light emission part assembly 220 also includes a cathode part 256 which is disposed outside the light path on the light emission window 218 side. The cathode part 256 is provided for generating thermal electrons, and to be more, specific, is formed by coating electron emitting material onto a coil which is extended in the tube axial direction and is made of tungsten. The cathode part 256 is electrically connected with the tip portion of a stem pin (not shown) standing on the stem part 216 via a connection pin so as to allow feeding of electric power from outside.

The light emission part assembly 220 further includes an electric discharge distributor 258 made of metal and a front surface cover 260 in order to prevent matter spattered or evaporated from the cathode part 256 from adhering to the light emission window. The electric discharge distributor 258 is disposed to surround the cathode part 256 and fixed on the upper surface of the supporting part 230. The front surface cover 260 is opposite the electric discharge distributor 258 and is fixed on the upper surface of the supporting part 230. Between the electric discharge distributor 258 and the front surface cover 260, a light passage opening 262 for letting discharge light pass through is formed. The electric discharge distributor 258 has an opening 264 in a portion that faces the front surface cover 260, and thermal electrons generated in the cathode part 256 pass through the opening 264.

The gas discharge tube 210 according to the second embodiment thus structured has the electric discharge path restricting part 228 and the electric discharge shielding part 250 which are substantially the same as their equivalents in the first embodiment, although there is a difference between a head-on type and a side-on type. In addition, the gas discharge tube 210 does not differ from the gas discharge tube 10 in size and positional relation, thereby bringing about an effect of securing generation of a startup discharge and a main discharge. Furthermore, since the arc ball has a stable, excellent shape, the emitted light has high brightness, sufficient light amount and stability. A detailed description of operations of the gas discharge tube 110 will be omitted because it is similar to that of the above-described gas discharge tube 10.

Figure 4:
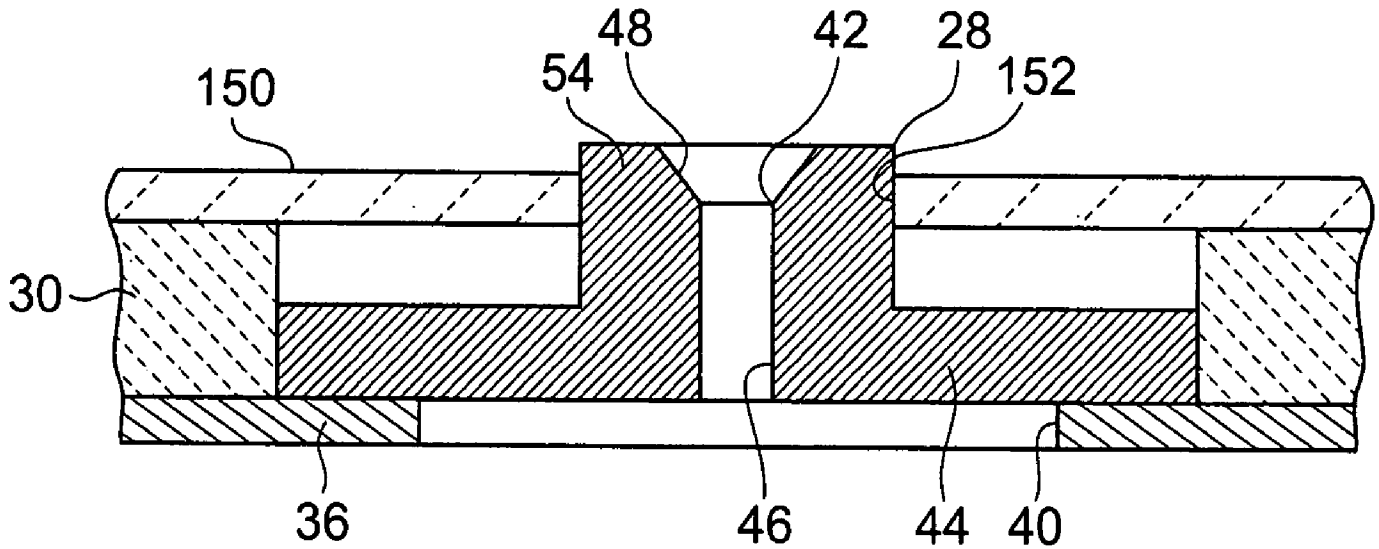
FIG. 4 is an enlarged cross sectional view of an electric discharge path restricting part in the gas discharge tube shown in FIG. 3.

The electric discharge shielding part 250 in the gas discharge tube 210 according to the second embodiment is made of conductive material such as metal; however, it may also be made of electrically insulating material such as ceramics, and in that case, those skilled in the art will understand easily that the structures shown in FIG. 3 to FIG. 5 can be formed as modifications of the first embodiment.

As described above, the gas discharge tube of the present invention has an effect of obtaining high brightness because of the provision of the electric discharge path restricting part for sufficiently narrowing an electric discharge path. The gas discharge tube has another effect of securing a main discharge because the positional relation between the electric discharge path restricting part and the electric discharge shielding part ensures the generation of a startup discharge at the tip portion of the electric discharge path restricting part, thereby advancing the startup discharge step by step.

As there is no need for providing a complicated power supply circuit, the cost in the whole device using the gas discharge tube of the present invention can be reduced.

Although the present invention and its advantages can be understood hereinbefore, it is obvious that the above-described embodiments are only typical preferable embodiments, and various modifications can be carried out in shape, structure and arrangement, without deviating from the spirit and scope of the present invention or losing the substantial advantages.

The invention claimed is:

1. A gas discharge tube comprising:

a sealed container in which gas is contained;

an anode part disposed in said sealed container;

a cathode part defining an electric discharge part for generating an electric discharge with said anode part, said cathode part being disposed inside said sealed container in such a manner as to be distanced from said anode part;

an electric discharge path restricting part being cylindrical and conductive and having a throughhole for narrowing said electric discharge path, said electric discharge path restricting part being disposed between said anode part and said cathode part, and being adapted to be electrically connected with an external power source; and an electric discharge shielding part disposed to enclose said electric discharge path restricting part, said electric discharge shielding part being electrically isolated from said electric discharge path restricting part, wherein said electric discharge path restricting part and said electric discharge shielding part are positioned in such a manner that an end part of said electric discharge path restricting part on said cathode part side projects beyond a surface of said electric discharge shielding part on said cathode part side by a predetermined amount of projection.

2. The gas discharge tube according to claim 1, wherein said amount of projection is approximately 0.5 mm at maximum.

3. The gas discharge tube according to claim 1, wherein said throughhole in said electric discharge path restricting part includes a small hole part which is provided on said anode part side and has a constant inner diameter, and a increased diameter hole part which is linked with said small hole part and extends toward said cathode part side while increasing in diameter toward the cathode part side in a funnel shape.

4. The gas discharge tube according to claim 3, wherein said increased diameter hole part in said electric discharge path restricting part has an inner peripheral surface which extends beyond a surface of said electric discharge shielding part that is on said cathode part side toward a surface of said electric discharge shielding part that is on said anode part side.

5. The gas discharge tube according to claim 3, wherein said increased diameter hole part has a maximum inner diameter (D2) in a range of 1 mm to 3 mm, and a ratio (D2/D1) of said maximum inner diameter (D2) of said increased diameter hole part to an inner diameter (D1) of said small-hole part in said electric discharge path restricting part is in a range of 4 to 10.

6. The gas discharge tube according to claim 1, wherein said electric discharge shielding part is made of electrically insulating material.

7. The gas discharge tube according to claim 1, wherein the gas in said sealed container is heavy hydrogen gas.

* * * * *